US005176334A

United States Patent [19]

Dreschau et al.

[11] Patent Number: 5,176,334

[45] Date of Patent: Jan. 5, 1993

[54] APPARATUS FOR MAINTAINING A TENSION IN AN ELONGATED CONTINUOUSLY ADVANCED FLEXIBLE ELEMENT

[75] Inventors: Rudolf Dreschau, Springe; Klaus Pack, Wiehl, both of Fed. Rep. of Germany

[73] Assignee: Stahlkontor Maschinenabau GmbH, Hameln, Fed. Rep. of Germany

[21] Appl. No.: 710,521

[22] Filed: Jun. 4, 1991

[30] Foreign Application Priority Data

Jun. 15, 1990 [DE] Fed. Rep. of Germany ..... 4019108

[51] Int. Cl.[5] ..... B65H 77/00

[52] U.S. Cl. ..... 242/75.5; 226/44

[58] Field of Search ..... 242/75.5, 75.51, 75.52, 242/75.53, 75, 75.2, 75.4, 75.43, 190; 226/44

[56] References Cited

U.S. PATENT DOCUMENTS

| | | | |
|---|---|---|---|
| 1,952,196 | 3/1934 | Coil | 242/75.43 |
| 2,067,755 | 1/1937 | Dyer, Jr. | 242/75.2 |
| 2,351,591 | 6/1944 | Balk | 242/75.5 |
| 3,183,495 | 5/1965 | Blain | 242/182 |
| 3,829,038 | 8/1974 | Studer | 242/75.51 X |
| 3,904,147 | 9/1975 | Taitel et al. | 242/75.43 X |
| 4,129,238 | 12/1978 | Herd | 242/75.43 X |
| 4,351,493 | 9/1982 | Sonnek | 242/75.51 X |
| 4,604,848 | 8/1986 | Clostermeyer | 242/75.2 X |
| 4,858,842 | 8/1989 | Mundus | 242/75.5 X |

FOREIGN PATENT DOCUMENTS

| | | | |
|---|---|---|---|
| 703893 | 3/1941 | Fed. Rep. of Germany . | |
| 1959065 | 7/1970 | Fed. Rep. of Germany . | |
| 2230680 | 1/1973 | Fed. Rep. of Germany . | |
| 2232496 | 1/1974 | Fed. Rep. of Germany . | |
| 1206391 | 2/1960 | France | 242/190 |
| 1222499 | 2/1971 | United Kingdom . | |

*Primary Examiner*—Daniel P. Stodola
*Assistant Examiner*—John P. Darling
*Attorney, Agent, or Firm*—Herbert Dubno

[57] ABSTRACT

A device for maintaining a freely selectable speed-independent tension in a continuously advanced flexible element, has a double-arm rocker and respective deflecting rollers uniformly disposed on arms of the rocker with said element passing around the rollers in opposite senses. The rocker is mounted to enable pivoting about a pivot axis between the rollers and at least one counterforce member is operatively connected to the rocker to counter pivotal movement of the rocker about this axis and establishing a tension in the element which is a function of a pivotal displacement of the rocker.

9 Claims, 4 Drawing Sheets

APPARATUS FOR MAINTAINING A TENSION IN AN ELONGATED CONTINUOUSLY ADVANCED FLEXIBLE ELEMENT

FIELD OF THE INVENTION

Our present invention relates to an apparatus for controlling or maintaining constant a freely selectable and speed-independent tension of strand-shaped or web-shaped coilable material of paper, plastic (synthetic resin), textile, metal or the like in conjunction with a coiling or uncoiling unit.

BACKGROUND OF THE INVENTION

Conventional coilers are provided with devices for controlling or maintaining constant the tension acting upon the coiled element with relatively expensive pendulously displaceable rolls or dancer rolls which bear upon the material to be coiled and are provided upstream of the coiler. Uncoiling units, units from which a continuous element such as a web or strand is drawn off a coil, can also be provided with a tensioning device for maintaining a predetermined tension in that element as it is fed to a processing operation downstream of the uncoiler.

Such devices for controlling the tension or maintaining the tension constant in webs or strands of materials in conjunction with coiling and uncoiling units are illustrated and described, for example, in German application 24 24 302 and in German open application 22 32 496. The mechanical construction of such tension-control devices makes them relatively expensive while the comparatively large number of deflection rolls about which the flexible element must pass imparts an excessive friction to the device, making the device unsuitable for many purposes. The devices are not readily adjustable for various tensions.

Another drawback of such earlier devices is that they are dependent for proper function upon a particular orientation and cannot be mounted with any wide range of application. For example, they cannot be readily mounted on the web or stand applicator arm of conventional coiling apparatus. As a consequence, it has been difficult, if not impossible, heretofore to retrofit coilers with such tension control devices.

OBJECTS OF THE INVENTION

It is, therefore, the principal object of our invention to provide a device for controlling o maintaining constant a freely selectable and speed-independent tension of a web or strand like coilable element of plastic, paper, textile, metal or the like in a coiling or uncoiling unit or apparatus whereby drawbacks of earlier devices are avoided.

More specifically, it is an object of this invention to provide an improved device for the purposes described which can apply a constant tension to webs or monofilaments in a variety of positions or applications, which is less sensitive to inertia than earlier systems, which is speed independent at least within limited angular displacements of its rocker member and which enables substantially free selection of the tension of the element.

It is another object of the invention to provide a device for the purposes described which is of comparatively low cost and is highly reliable.

Still another object of our invention is to provide a tension regulating device which can reduce tension fluctuations and nonuniformities to a minimum and reduce tension surges in the winding of the coil or during uncoiling to zero.

SUMMARY OF THE INVENTION

These objects and others which will become apparent hereinafter are attained, in accordance with the invention by providing ahead of or upstream of a coiler or behind or downstream of an uncoiler, similarly shaped and double-armed deflecting means traversed by the strand or web and having at least one counterforce element coupled to the rocker of the deflecting means and exerting a force thereon countering the force applied to the rocker by the web or strand. The counterforce element is advantageously a resilient element whose restoring force is proportional to its displacement.

The deflecting means can comprise a bearing housing and a rocker pivotally displaceable on the bearing housing, the rocker having symmetrical and balanced pivotal arms at the ends of which deflecting rolls are provided such that the element passes around the rolls in opposite senses. The angular displacement of the rocker about its pivot axis is detected by an angular displacement sensor, for example, a current or voltage plate, the output of which represents the angular displacement of the rock and is used, via conventional control technology, to regulate the advance of the element and thus restore a given tension thereof should there be a deviation from a predetermined position of the rocker.

More particularly, a device for maintaining a freely selectable speed-independent tension in a continuously advanced flexible element can comprise, between a source and a receiver of the element:

a double-arm rocker;

respective deflecting rollers uniformly disposed on arms of the rocker with the element passing around the rollers in opposite senses;

means for mounting the rocker to enable pivoting thereof about a pivot axis between the rollers; and at least one counterforce member operatively connected to the rocker, countering pivotal movement of the rocker about the axis and establishing a tension in the element which is a function of a pivotal displacement of the rocker.

The source can be a coil of the element when the device is used downstream of an unwinding device and upstream of a processing facility to which the element is to be fed with constant tension. Alternatively, the receiver can be a coiler to which the element is fed with constant tension. The element itself according to the invention can be a web or strand of any coilable material, for example, a plastic, paper, textile, metal or the like.

The counterforce element can be at least one tension element, for example, a tension spring. The angular position of the rocker about its pivot axis can be influenced by the spring or by a pair of such springs when two counterforce elements are provided in the form of the pair of springs. In other words the spring or springs can establish a zero position of the rocker and the tension applied by the device and maintained by the device in the web or strand will be a function of any angular displacement from the zero position. Once the angular position corresponding to a given tension is established, the sensor controls the drive for the element to vary the drive and maintain that tension.

In other words the tension on the element is a function of the angular displacement from the zero position established by the tension spring or springs. If a linear dependency between the tension and the ,measurement signal is desired, it has been found to be advantageous to provide two substantially parallel springs which can be connected at their ends by a cable which can be guided around a cable roller concentric with the pivot axis and hence the angle sensor. It has been found to be advantageous to provide the spring constants of the two springs so that they differ. For example, the spring constants can be in a ratio of 10:1 to 20:1.

The tension in the cable is thus given by $$F_{\text{cable}} = \Delta L(C1 + C2)$$

in which

C1 = Constant of spring 1

C2 = Constant of spring 2

ΔL = angular displacement of the cable roller x radius of the cable roller,

By varying the spring constants, therefore, we are able to vary the measurement range of the element tension controlling device.

To adjust the spring characteristics, the ends of the springs connected to the housing can be provided with variable adjusting elements. If no linear dependency between the angular displacement of the rocker and the tension is required, the tension element acting on the rocker can be a single spring which is so connected to the rocker that it may be affixed to a rotary plate of the rocker which is centered on the axis or center of the angle sensor. The pretension of the spring establishes a zero point for the measurement range.

The tension controlling device of the invention is independent of the orientation with which it is mounted and thus it can be readily integrated into a coiler by providing the axis of the angular sensor and the cable roller and rocker so that it is substantially horizontal and the spring or springs so that they are substantially vertical.

Of particular advantage is the fact that the device of the invention does not have a particular stop point or abutment defining an end position and thus can be a low inertia, low mass apparatus which can operate independently of its orientation and independently of the speed of the web. It can be used in production equipment to control the tension of the continuous element from the finest threads to the widest webs in the plastics, papers and textile producing industries. In that case, for threads, cords, yarn, cable and other narrow strands, relatively thin rollers can be used while in the case of wide webs, relatively long rollers can be employed as the deflecting rollers.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
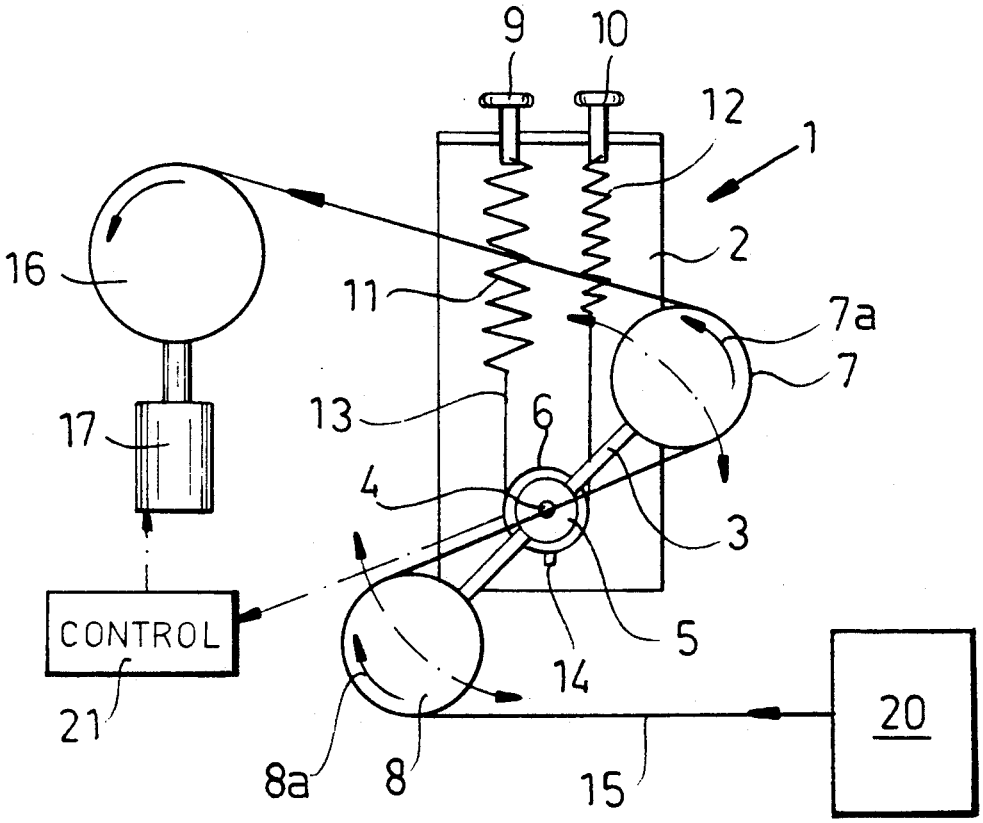
FIG. 1 is a diagram of a first embodiment of the invention utilizing two tension elements acting upon the rocker.

The embodiment of FIG. 1 is a tension control device which comprises a bearing housing 2 and a rocker which consists of a balanced swing arm 3 journaled in this housing. On the substantially horizontally extending pivot axis 4 of the swing arm 3, an angle sensor 5 is mounted to output an electronic signal representing the angular displacement of the rocker about its axis, and a cable roller 6 is affixed to the arm 3.

On the ends of the arm 3 are provided symmetrical deflecting rollers or drums 7, 8 depending upon whether the element is a strand or web. The bearing housing 2 also has adjustment elements 9 and 10 which can be screws or the like acting upon the respective springs 11 and 12 which form the counterforce elements. The springs 11 and 12, which are mutually parallel, have different spring constants as previously indicated.

They are connected at their ends with a cable 13 which extends around the cable roller 6. The cable 13 is held on the cable roller 6 by means of a clamp 14.

The web 15 or other continuous element as to which the tension is to be controlled, is guided around the rollers 7 and 8 in opposite senses as represented by the arrows 7*a* and 8*a*, respectively, from a source represented only at 20 to a coiler 16 driven by a coiler drive 17. The output from the sensor 5 is fed to a controller, preferably a proportional-integral-differential or PID controller 21 for control of the drive 17 of the coiler.

It will be apparent that, in the absence of tension in the element 15, the springs 11 and 12 can establish a zero point position of the swing arm or rocker 3. The web tension can then be controlled at a certain level by the PID controller and the rocker 3 will assume an angular position which is proportional to the tension to be maintained in the web. Once the setpoint tension is reached, any tension irregularities or tension surges will result in slight angular displacements of the rocker 3 about the setpoint position and will be detected by the angle sensor 5 to control the drive 17 and restore the setpoint position. The sensor 5 on the axis 4 can provide these signals to a signalling or displaying device so that the tension maintaining device can also serve as a measuring unit for signalling or displaying the tension.

Figure 2:
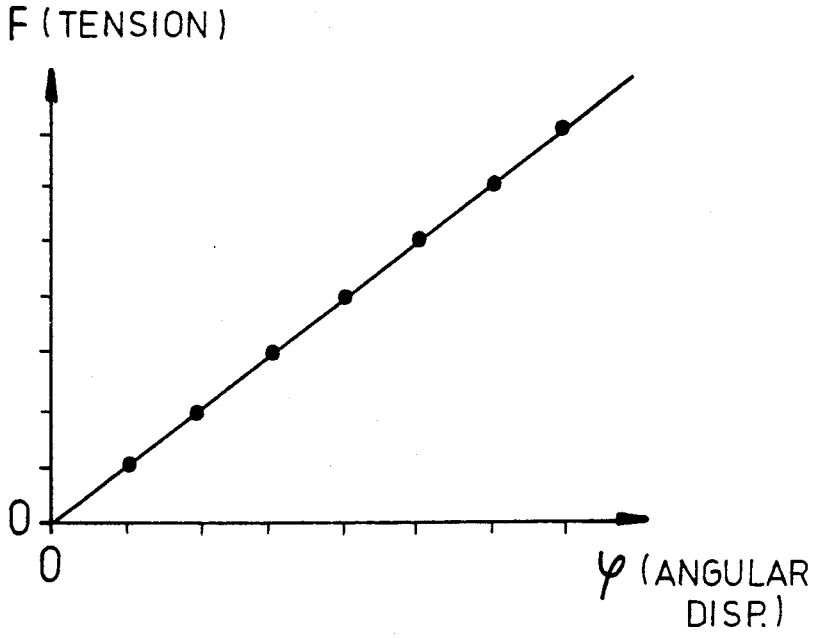
FIG. 2 is a graph illustrating the linear characteristic of the system of FIG. 1.
Figure 3:
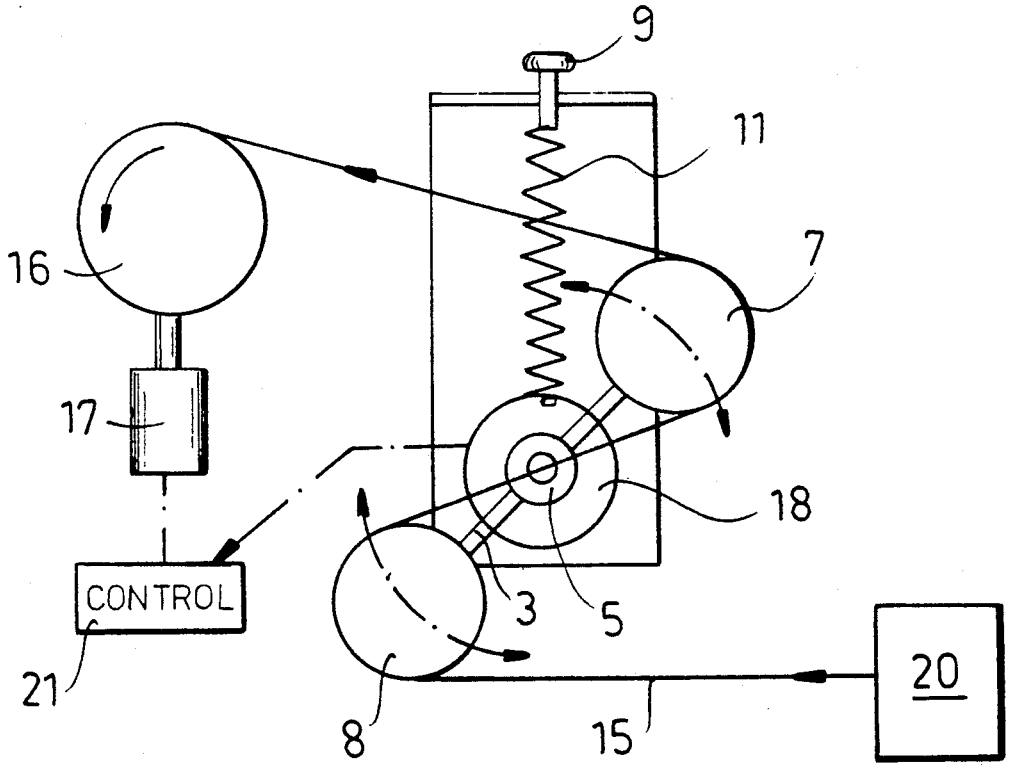
FIG. 3 is a diagram similar to FIG. 1 but showing an embodiment utilizing one tension element or spring.
Figure 4:
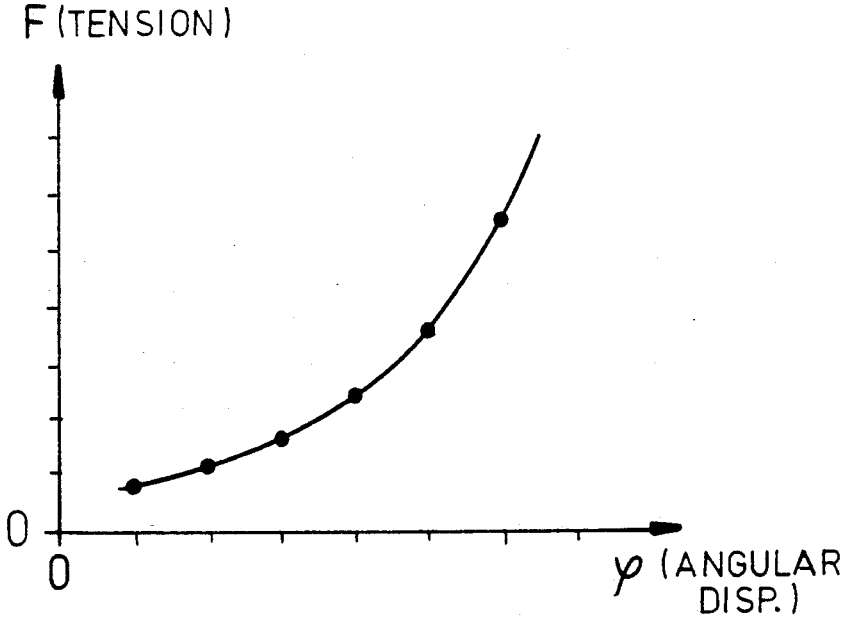
FIG. 4 is a graph showing the substantially parabolic tension characteristic of this embodiment.

In the embodiment of FIG. 3, where similar reference numerals are used to represent similarly functioning parts, only one spring 11 is provided with an adjusting element 9 to vary the spring constant thereof. The spring 11 is anchored to a rotary plate 18 connected to the rocker 3, rotatable about the axis 4 and connected to the angle sensor 5. In operation, the device of FIG. 3 operates similarly to that of FIG. 1 with the only difference being the characteristic of the tension control device. For the embodiment of FIG. 3, this characteristic, where the tension F is plotted along the ordinate against the angular displacement $\phi$ of the rocker arm from the zero position established by the spring, is a parabola. The characteristic of the embodiment of FIG. 1, by contrast, is linear as has been shown in FIG. 2.

Instead of springs, other tension elements which have a resilient characteristic or a restoring force which is a function of displacement can also be used, e.g. pneumatic cylinders, magnetic devices, etc. The devices of FIGS. 1 and 3 can also be used for uncoiling or coil unwinding machines by simply providing the source 20 as a coil and member 16 as a receiver for the web or strand. In that case the controller 21 may regulate a brake for the unwinding coil.

We claim:

1. A device for maintaining a freely selectable speed-independent tension in a continuously advanced flexible element, the device comprising, between a source and a receiver of the element:

a housing;

a rocker having arms directed oppositely from a central rocker pivot axis;

bearing means for mounting the rocker for pivoting on the housing about the axis;

respective deflecting rollers uniformly disposed on the arms of the rocker with the element passing around the rollers in opposite senses;

a pair of springs extending generally parallel to each other and each anchored at one end to the rocker at a respective location offset form the axis; and respective means at an opposite end of each spring for bracing the respective opposite end on the housing and for adjusting the respective spring force.

2. The device defined in claim 1 wherein said rocker is located upstream along a path of said flexible element of a coiling station at which said flexible element is wound in a coil.

3. The device defined in claim 1 wherein said rocker is located downstream along a path of said flexible element of a coiling station at which said flexible element is unwound from a coil.

4. The device defined in claim 1 wherein said arms carrying said rollers extend symmetrically to opposite sides of said axis, the device further comprising angle sensor means responsive to angular displacement of said arms about said axis for controlling displacement of said flexible element along a path through said device.

5. The device defined in claim 4 wherein said pivot axis is substantially horizontal and said springs are substantially vertical.

6. The device defined in claim 1 wherein said springs have different spring constants.

7. The device defined in claim 6 wherein the spring constant of one of said springs is in a ratio to the spring constant of the other of said springs of 10:1 to 20:1.

8. The tension-maintaining device defined in claim 1 further comprising a circular element fixed to the rocker and rotatable jointly therewith about the axis;

a cable interconnecting the one ends of the springs and looped over the circular element; and means fixing the cable between the one ends to the element.

9. The tension-maintaining device defined in claim 1 wherein the springs are tension springs.

* * * * *